United States Patent [19]

Bovi et al.

[11] Patent Number: 4,674,989

[45] Date of Patent: Jun. 23, 1987

[54] FIGURE TOY WITH SIMULATED LEG ACTION AND PIVOTED STRIKING ELEMENT

[75] Inventors: Robert D. Bovi, Westfield, Mass.; Richard I. Farrington, New Britain, Conn.

[73] Assignee: Coleco Industries, Inc., West Hartford, Conn.

[21] Appl. No.: 826,847

[22] Filed: Feb. 6, 1986

[51] Int. Cl.[4] ..... A63H 13/00

[52] U.S. Cl. ..... 446/336; 446/359

[58] Field of Search ..... 446/327, 336, 334, 359, 446/309, 308, 330

[56] References Cited

U.S. PATENT DOCUMENTS

| | | | |
|---|---|---|---|
| 506,619 | 10/1893 | Bailey . | |
| 752,607 | 2/1904 | Thowless . | |
| 1,417,958 | 5/1922 | Vogt . | |
| 1,747,487 | 2/1930 | Salo . | |
| 2,114,851 | 4/1938 | McCown . | |
| 2,151,546 | 3/1939 | Arnold | 446/308 |
| 3,769,745 | 11/1973 | Crosman | 446/359 X |
| 3,906,661 | 9/1975 | Weiser | 446/336 X |
| 4,180,939 | 1/1980 | Matsushiro . | |
| 4,573,944 | 3/1986 | Crow et al. | 446/336 X |
| 4,585,425 | 4/1986 | Amici et al. | 446/327 |

FOREIGN PATENT DOCUMENTS

| | | | |
|---|---|---|---|
| 337132 | 5/1921 | Fed. Rep. of Germany | 446/327 |

*Primary Examiner*—Mickey Yu

[57] ABSTRACT

An armed toy creature figure has an axe-like element pivotably mounted along its back, which strikes forwardly when disengaged. The plunger for actuating the striker element is associated with the holder by which the figure is supported on the operator's hand, and the figure has flexible legs which carry ring pieces for receiving the tips of the operator's fingers, to permit convenient animation thereof.

9 Claims, 9 Drawing Figures

FIGURE TOY WITH SIMULATED LEG ACTION AND PIVOTED STRIKING ELEMENT

BACKGROUND OF THE INVENTION

An ongoing demand exists for action toys having novel features. It is of course important that any such toy be effective in its appearance and operation, while being durable and relatively facile and inexpensive to manufacture. The prior art discloses numerous forms of action toys in which various parts can be moved in different ways; typical are the following United States patents:

Finger walking dolls are shown in Thowless U.S. Pat. No. 752,607, and Vogt U.S. Pat. No. 1,417,958.

In Salo U.S. Pat. No. 1,747,487, pivoted hammers are operated by a reciprocating slide.

In McCown U.S. Pat. No. 2,114,851, a finger-hold member is operated to move the eyes of a ventriloquist's dummy, and a finger loop is used for articulation of its jaw.

In Matsushiro U.S. Pat. No. 4,180,939, a sliding bar is used to effect the release of a helicopter toy.

It is an object of the present invention to provide a novel toy creature figure having a unique action feature in the form of a striker element.

It is also an object of the invention to provide such a figure wherein a unique mechanism is provided for latching and actuating the striker element.

Another object of the invention is to provide such a figure having movable limbs with means for conveniently gripping and animating them.

Another object of the invention is to provide a novel toy figure having the foregoing features and advantages, additionally including means for holding the figure while actuating the striker element and moving the limbs.

Additional objects of the invention are to provide such toy creature figures which are effective in their appearance and operation, are durable, and are relatively facile and inexpensive to manufacture.

SUMMARY OF THE INVENTION

It has now been found that certain of the foregoing and related objects of the invention are attained by the provision of a toy creature figure having a striker element pivotably mounted adjacent the forward end portion of its body for movement between an armed position, in which the element extends along a back portion of the body on an axis between its opposite end portions, and a released position with the element extending forwardly of the body. Biasing means urges the striker element toward the released position, and latch means engages it in its armed position; disengagement of the latch means from the stricker element is effected by operation of the release means provided.

In the preferred embodiments, the latch means will comprise an elongated latching member mounted within the body beneath the striker element and having one end portion adapted for engagement therewith. The striker element will have a recess or notch therein disposed to slidably receive the end portion of the latch means in the armed position, and the latching member will be sufficiently flexible to permit bowing under manual force, applied by the release means, so as to effect disengagement of the end portion from the recess.

The release means will normally comprise a member accessible from the front portion of the body and movable thereinto. Advantageously, the body and latching member will have means thereon for constraining the "one" end portion thereof to substantially sliding movement along the axis of the member, and the latch means will include a lever arm rigidly joined to the latching member and extending in the axial direction thereof toward its "one" end portion. Such latch means will be pivotably mounted within the body, on a laterally extending axis and at a point adjacent the juncture between the lever arm and latching member, so that force upon the lever arm will cause deflection of the latching member, as described. The constraining means employed may consist of laterally extending elements on the end portion of the latching member, and cooperative means defining guide slots on laterally adjacent parts of the body and slidably engaging the laterally extending elements. The release means may comprise a plunger that is slidably mounted for movement through the front portion of the body, which has an inner end portion disposed within the body to contact the lever arm, and an outer end portion lying outwardly of the body for actuating contact.

Generally, the figure will additionally include a holder rigidly attached to the front portion of the body and adapted to be firmly grasped. A pair of flexible, leg-simulating appendages will desirably extend beyond the front portion of the body and forwardly of the holder, with each of them having a ring piece thereon adapted for fingertip engagement, so that movement can be imparted thereto by two of the user's fingers inserted through openings in the holder. The ring pieces may be in the form of closed loops, each comprised of relatively large and relatively small generally circular parts which are interconnected by a narrow neck part, the relatively small circular part being adapted to seat an appendage portion of reduced cross-section.

DETAILED DESCRIPTION OF THE ILLUSTRATED EMBODIMENT

Turning now in detail to the appended drawings, therein illustrated is a toy figure embodying the present invention, which is in the form of a fantastic, insect-like creature; it will of course be appreciated, however, that figures embodying the invention may take widely diverse forms. The toy shown has a generally hollow body provided by left and right sections, which are generally designed respectively by the numerals 10 and 12 and will usually be fabricated from a synthetic resin, such as ABS copolymer. An axe-like striker element, also made of plastic and generally designed by the numeral 14, is mounted upon the back, or dorsal, portion of the body, and an antenna-simulating part 18 is mounted upon the head portion; a leg member and a holder, generally designed respectively by the numerals 16 and 20, are affixed upon the lower, or ventral, portion of the body.

Figure 1:
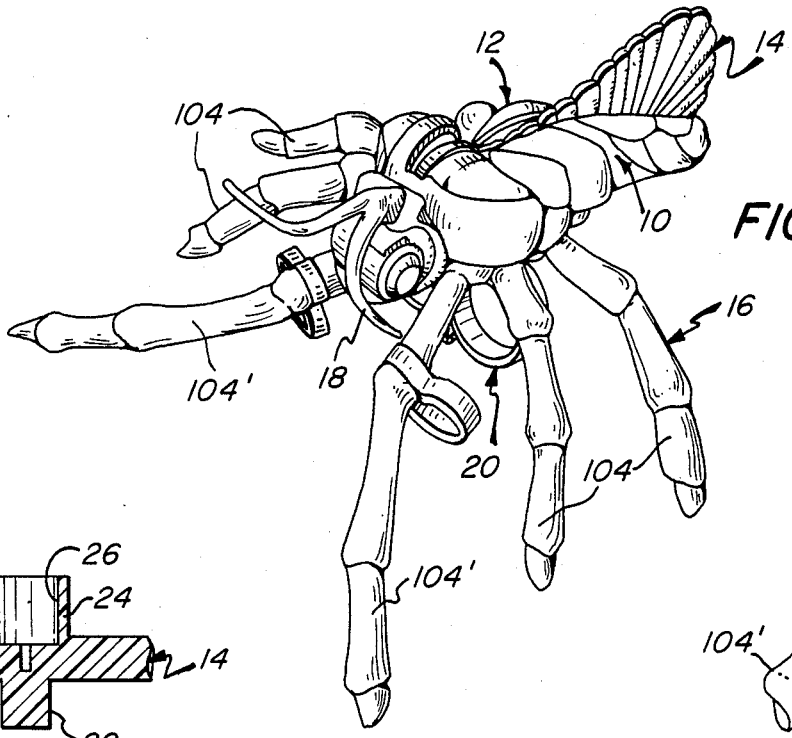
FIG. 1 is perspective view of a toy creature figure embodying the present invention.
Figure 3:
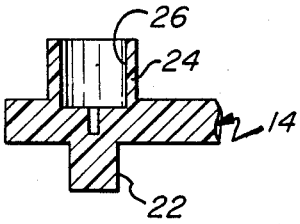
FIG. 3 is a fragmentary sectional view, taken along line 3—3 of FIG. 2 and drawn to a scale further enlarged therefrom, showing the forward end of the striker element by which it is pivotably mounted within the body of the toy figure.
Figure 4:
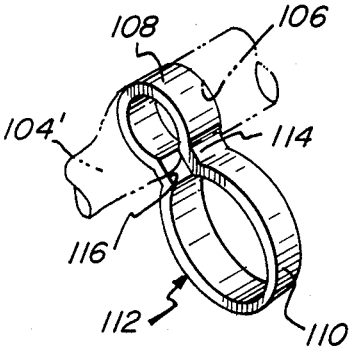
FIG. 4 is a fragmentary perspective view of one of the forward legs (in phantom line) of the toy creature of FIG. 1, drawn to a scale greatly enlarged therefrom and showing a finger-engaging ring piece mounted thereupon.
Figure 7:
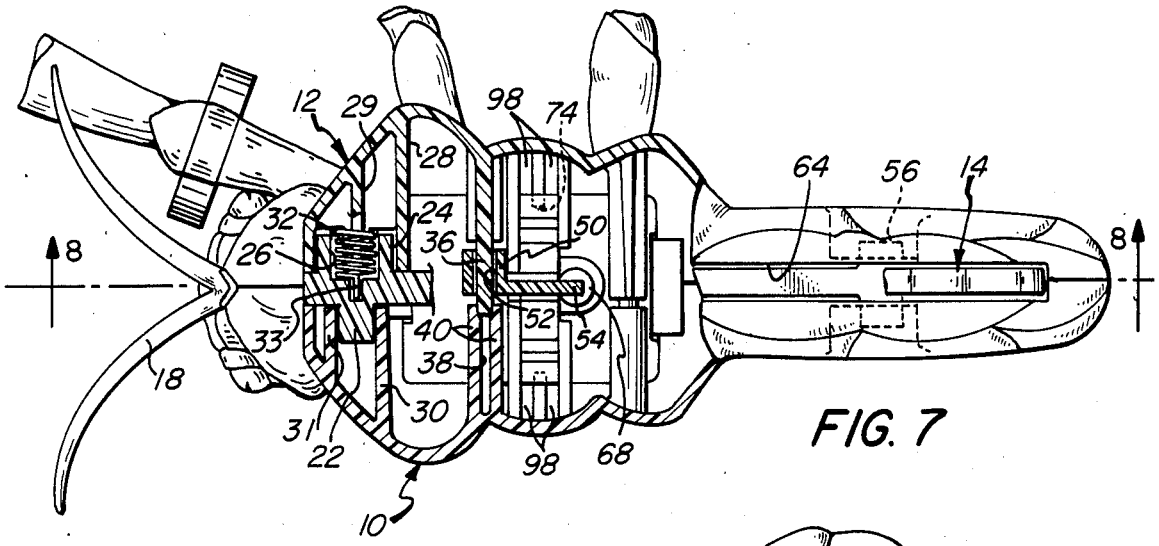
FIG. 7 is a fragmentary plan view of the toy in partial section, taken substantially along line 7—7 of FIG. 8.

The forward end portion of the striker element 14 has a stub axle component 22 and a hub component 24 extending from the opposite sides thereof; they are aligned on a transverse axis, and the hub component 24 provides a small socket 26. Rib elements 28, 29, 30, 31 cooperate to rotatably seat the stub axle and hub components, thereby pivotably mounting the striker element 14. A torsion spring 32 is disposed within the socket 26, with its opposite end portions 33, 35 engaged within small holes in the striker element and an internal body wall, respectively; the spring is conditioned to bias the striker element from its armed, or closed, position (shown in FIGS. 1, 7 and 8) toward its released, or open, position (shown in FIG. 9).

A pin portion 36 on the section 12 extends across the longitudinal centerline of the body and is engaged within the bore 38 defined by elements 40. Pivotably mounted upon the pin portion 36 is a latch, generally designed by the numeral 42, consisting of an elongated bar or beam portion 44 having a nose portion 46 at its rearward end and a pivot mount portion 48 adjacent its forward end, the latter having a transversely extending bore 52 through which the mounting pin portion 36 extends, surrounded by a collar element 50. A lever arm element 54 extends rearwardly from the pivot mount 48 beneath the bar portion 44. The latch 42 also has a pair of laterally extending ear elements 56 formed thereon adjacent the nose portion 46, which are slidably engaged within longitudinally extending slots 58, defined by elements 60 formed on each of the body sections 10, 12.

Figure 2:
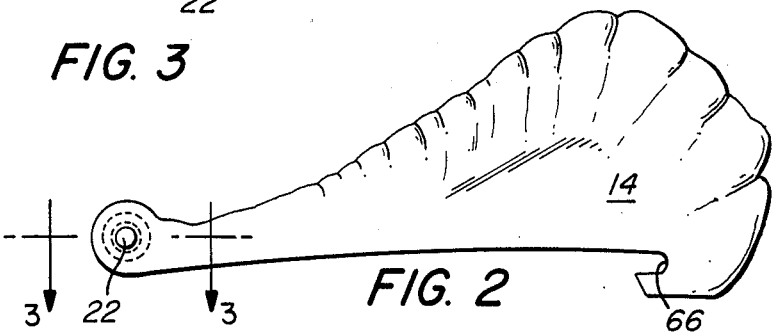
FIG. 2 is a side elevational view, drawn to an enlarged scale, of the striker element employed in the toy of FIG. 1.
Figure 5:
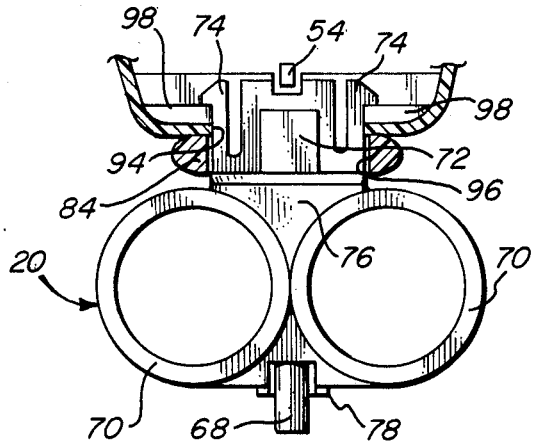
FIG. 5 is a fragmentary sectional view of a ventral portion of the toy, taken along the section line of FIG. 8 (which is unnumbered, for clarity of illustration) and showing the holder and the outer portion of the striker member actuating plunger.
Figure 6:
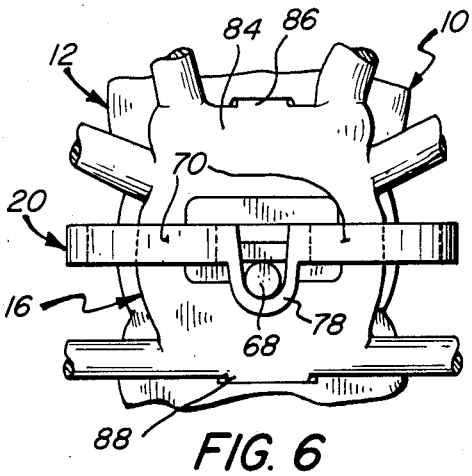
FIG. 6 is a fragmentary bottom view showing features illustrated in FIG. 5.
Figure 8:
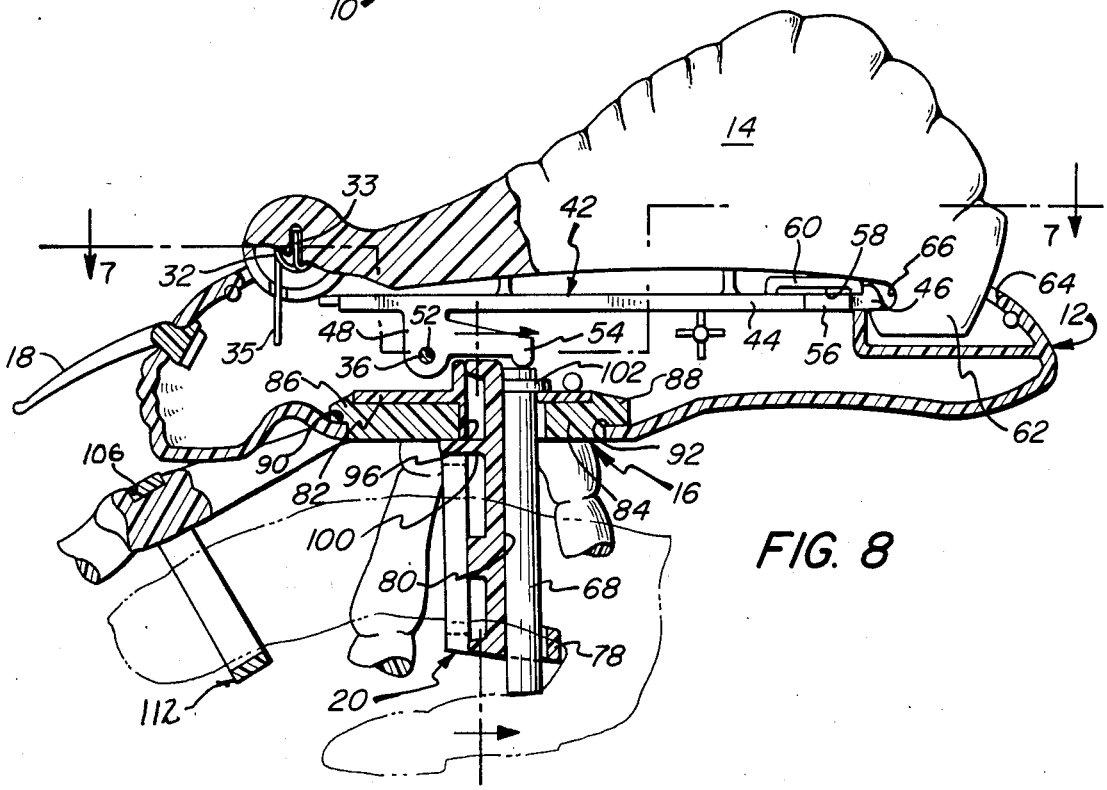
FIG. 8 is a fragmentary side elevational view in partial section, taken along line 8—8 of FIG. 7 and depicting the toy figure supported upon the user's hand (shown in phantom line), with the striker element in its armed position.
Figure 9:
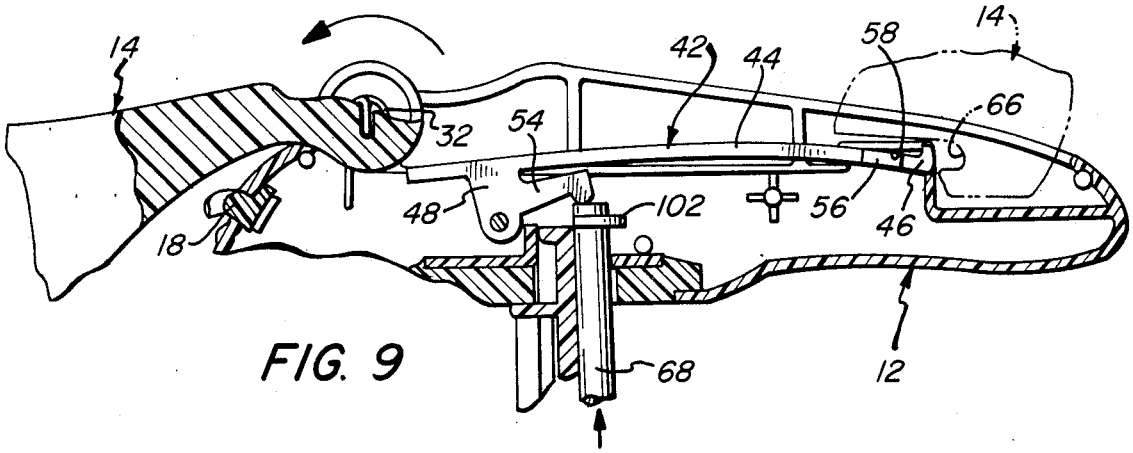
FIG. 9 is a fragmentary elevational view similar to FIG. 8, illustrating the latch means disengaged from the striker element and showing the latter in its forwardly pivoted position.

As is best seen in FIGS. 2 and 8, in the closed position of the striker element 14 its lower edge lies within the elongated dorsal slot 64, which is cooperatively formed by the sections 10, 12, with a tongue portion 62 projecting into the body. A shallow notch 66 is formed into the inner edge of the tongue portion, and serves to engage the nose portion 46 of the latch 42 for retention of the striker element. Release is effected simply by displacing the nose portion 46 from the notch 66, which is achieved by causing the bar portion 44 to bow upwardly, as depicted in FIG. 9. It will be appreciated that the latch 42 is fabricated from a relatively rigid and yet resiliently deflectable material, such as may be provided by an acetal copolyer resin, to securely interlock with the element 14 while affording the flexibility necessary for withdrawal. As will also be appreciated, engagement of the ear components 56 within the lateral slots 58 constrains the nose portion 46 to substantially linear movement despite bowing of the bar portion 44.

Release of the latch 42 is actuated by the rod 68, which is slidably mounted upon the holder 20. The inner end portion of the rod bears upon the outer end of the lever arm 54; thus, inward force on the rod will pivot the lever arm 54, which will in turn act through the pivot mount portion 48 to bend the beam portion 44 upwardly, as shown in FIG. 9. Such movement can conveniently be produced either by thumb pressure on the rod or by pressing its outer end against any accessible surface.

The holder 20 consists of a gripping portion comprised of a pair of side-by-side ring elements 70 joined by a web portion 76, and an attachment portion 72 which includes two integral, resiliently deflectible barb elements 74. A collar element 78 extends rearwardly and it, together with the half-round groove 80 formed along the back surface of the holder 20, serves to guide the outer end portion of the actuating rod 68. The body sections 10, 12 cooperate with the upper part of the holder attachment portion 72 to define the passage for the inner portion of the actuating rod 68, which has a semicircular collar formation 102 thereon to prevent inadvertent disassembly.

The two body sections 10, 12 also have inset portions 82 thereon, which cooperatively define a shallow recess within which the connecting web portion 84 of the leg member 16 is seated. The web portion 84 has shoulder elements 86, 88 on its opposite ends which fit, respectively, within slots 90, 92 defined along the edges of portion 82. An opening 94 to the interior of the body is defined between the sections 10, 12, with which is aligned a similarly dimensioned and configured opening 96 formed through the web portion 84 of the leg member. Rib formations 98 extend laterally along the lower surfaces of the two body sections, and terminate at the body opening 94. The attachment portion 72 of the holder 20 is inserted through the leg member opening 96 and into the body opening 94, with the barb elements 74 catching upon the upper surfaces of the rib elements 98, and with the ledge element 100 on the holder 20 bearing upon the bottom surface of the web portion 84. In this manner the holder 20 and leg member 16 are secured to the body.

The leg member 16 is formed to simulated six leg elements 104, which are symmetrically disposed with respect to the body of the creature; the member 16 will normally be made of a synthetic resinous material, such as PVC, which will preferably be of a low durometer value (e.g., 50) so as to permit facile movement of the appendages. Each of the two forward leg elements 104' has a peripheral groove 106 formed into it, within which is seated the smaller of two circular elements 108, 110 of a ring piece, generally designated by the numeral 112. The circular elements 108, 110 are connected by a neck portion consisting of two generally parallel rectilinear elements 114, which cooperatively define a relatively narrow channel 116. Mounting of the ring piece is readily achieved simply by inserting the leg element 104' through the larger of the two circular portions, and then sliding it through the channel 116 into the smaller portion 108.

As can be seen in FIG. 8, the figure is normally held by insertion of the user's forefinger and middle finger through the openings of the ring portions 70 of the holder 20, with his fingertips engaged within the larger circular elements 110 of two ring pieces 112. Accordingly, his hand will be positioned for convenient animation of the forelegs 104', as well as for operation of the actuating plunger 68.

Thus, it can be seen that the present invention provides a novel toy creature figure having a unique action feature in the form of a striker element. The toy incorporates a novel mechanism for latching and actuating the striker element, and it has movable limbs with means for conveniently gripping and animating them, and for holding the figure while simultaneously actuating the striker element. The toy figure of the invention is effective in its appearance and operation, is durable, and is relatively facile and inexpensive to manufacture.

Having thus described the invention, what is claimed is:

1. A toy creature figure having a pivoted striker element, comprising:

a toy creature body having front, back, forward end and rearward end portions.

an elongated striker element pivotably mounted upon said body adjacent said forward end portion for movement between an armed position, with said element extending endwise along said back portion of said body, and a released position with said element extended forwardly of said body;

biasing means urging said striker element toward said released position;

latch means for engaging said striker element to maintain it in said armed position; and release means for effecting disengagement of said latch means from said striker element, operation of said release means thereby permitting said biasing means to pivot said element from said armed position to said released position thereof, said latch means comprising an elongated latching member mounted within said body beneath said striker element and having one end portion adapted for engagement therewith, said body and latching member having cooperating means thereon for constraining said one end portion to substantially sliding movement along the axis of said member, said striker element having a recess formed therein disposed to slidably receive said one end portion of said latch means in said armed position, said latching member being sufficiently flexible to permit bowing under manual force so as to effect disengagement of said one end portion from said recess, and said release means being operatively connected to said latch means so that operation of said release means causes such bowing of said latching member and thereby release of said striker element from said armed position thereof.

2. The figure of claim 1 wherein said latch means includes a lever arm rigidly joined to said latching member and extending generally in the axial direction thereof toward said one end portion, said latch means being pivotably mounted within said body, on a laterally extending axis and at a point adjacent the juncture between said lever arm and latching member, so that force upon said lever arm will produce bowing of said latching member.

3. The figure of claim 1 wherein said constraining means comprises laterally extending elements on said one end portion of said latching member, and cooperative means defining guide slots disposed on laterally adjacent parts of said body and slidably engaging said laterally extending elements.

4. The figure of claim 1 wherein said release means comprises a member accessible from the front portion of said body and movable thereinto.

5. The figure of claim 2 wherein said release means comprises a plunger slidably mounted for movement through said front portion of said body, said plunger having an inner end portion disposed within said body for contact upon said lever arm, so as to produce such force thereon, and an outer end portion lying outwardly of said body and accessible for contact so as to effect such movement of said plunger.

6. The figure of claim 1 additionally including a holder rigidly attached to said body and disposed on said front portion thereof, said holder having a pair of side-by-side openings formed therein to receive two of the user's fingers for firm grasping thereof.

7. A toy creature figure having a pivoted striker element, comprising:

a toy creature body having front, back, forward end and rearward end portions;

an elongated striker element pivotably mounted upon said body adjacent said forward end portion for movement between an armed position, with said element extending endwise along said back portion of said body, and a released position with said element extending forwardly of said body;

biasing means urging said striker element toward said released position;

latch means for engaging said striker element to maintain it in said armed position;

release means for effecting disengagment of said latch means from said striker element, operation of said release means thereby permitting said biasing means to pivot said element from said armed position to said released position thereof;

a holder rigidly attached to said body and disposed on said front portion thereof, said holder having a pair of side-by-side openings formed therein to receive two of the user's fingers for firm grasping thereof; and a pair of flexible, leg-simulating appendages extending beyond said front portion of said body and forwardly of said holder, each of said appendages having a ring piece thereon adapted for fingertip engagement, so that movement can be imparted thereto by two of the user's fingers inserted through said holder openings and engaged within said ring pieces.

8. The figure of claim 7 wherein each of said ring pieces is in the form of a closed loop and comprises a relatively large, generally circular part, a relatively small, generally circular part, and a relatively narrow neck part therebetween; and wherein each of said appendages has a section thereon of reduced cross-section and configured to fit snugly within said relatively small part of the associated ring piece.

9. The figure of claim 7 wherein said release means comprises a plunger slidably mounted for movement through said front portion of said body, said plunger having an inner end portion disposed within said body for activation of said latch means, and an outer end portion lying outwardly of said body for actuating contact, and wherein siid holder has a channel formed therealong within which said plunger of said release means is slidably engaged with said outer end portion thereof projecting outwardly of said side-by-side openings.

* * * * *